US006497753B1

(12) United States Patent
Gutmann

(10) Patent No.: US 6,497,753 B1
(45) Date of Patent: Dec. 24, 2002

(54) ELECTROSTATIC AIR CLEANER

(75) Inventor: Rudolf Gutmann, Mühlacker (DE)

(73) Assignee: Baltic Metalltechnik GmbH, Grevesmuhlen (DE)

( * ) Notice: Subject to any disclaimer, the term of this patent is extended or adjusted under 35 U.S.C. 154(b) by 0 days.

(21) Appl. No.: 09/763,178

(22) PCT Filed: Aug. 18, 1999

(86) PCT No.: PCT/EP99/06050

§ 371 (c)(1),
(2), (4) Date: Feb. 20, 2001

(87) PCT Pub. No.: WO00/10713

PCT Pub. Date: Mar. 2, 2000

(30) Foreign Application Priority Data

Aug. 20, 1998 (DE) ..... 198 37 727

(51) Int. Cl.[7] ..... B03C 3/011

(52) U.S. Cl. ..... 96/55; 96/58; 96/63; 96/73; 96/381

(58) Field of Search ..... 96/62, 63, 73, 96/55, 57, 58, 60, 381

(56) References Cited

U.S. PATENT DOCUMENTS

| | | | | | |
|---|---|---|---|---|---|
| 2,711,225 | A | * | 6/1955 | Armstrong et al. | 96/73 X |
| 3,804,942 | A | * | 4/1974 | Kato et al. | 96/381 X |
| 4,042,354 | A | | 8/1977 | Tully | 55/DIG. 38 |
| 4,477,263 | A | * | 10/1984 | Shaver et al. | 96/58 X |
| 4,597,781 | A | * | 7/1986 | Spector | 96/57 X |
| 5,009,677 | A | * | 4/1991 | Wolf et al. | 96/73 X |
| 5,254,155 | A | * | 10/1993 | Mensi | 96/62 X |
| 5,616,172 | A | * | 4/1997 | Tuckerman et al. | 96/63 X |
| 5,632,806 | A | * | 5/1997 | Galassi | 96/55 X |
| 6,296,692 | B1 | * | 10/2001 | Gutmann | 96/62 |
| 6,322,614 | B1 | * | 11/2001 | Tillmans | 96/63 X |

FOREIGN PATENT DOCUMENTS

| | | | |
|---|---|---|---|
| DE | 60738 | 3/1968 | |
| DE | 26 41 114 | 3/1978 | |
| DE | 39 00 553 | 12/1989 | |
| DE | 36 22 673 | 1/1990 | |
| DE | 39 30 872 | 1/1992 | |
| DE | 195 30 785 | 11/1996 | |
| EP | 0 352 451 | 1/1990 | |
| WO | WO 96/35513 | * 11/1996 | 96/62 |

* cited by examiner

*Primary Examiner*—Richard L. Chiesa
(74) *Attorney, Agent, or Firm*—Venable; Robert Kinberg; Chad C. Anderson

(57) ABSTRACT

A device for cleaning gases includes a housing and a plurality of electrostatic filter units. Each of the filter units have a tube-shaped covering, and the housing has an intake opening at one end and an outlet opening at the other end for gas flow. The filter units have an essentially airtight arrangement within the housing. The filter units combine to form a filter assembly arranged inside the housing such that the assembly can be inserted and removed from the housing in one piece.

21 Claims, 3 Drawing Sheets

ELECTROSTATIC AIR CLEANER

Figure 1:
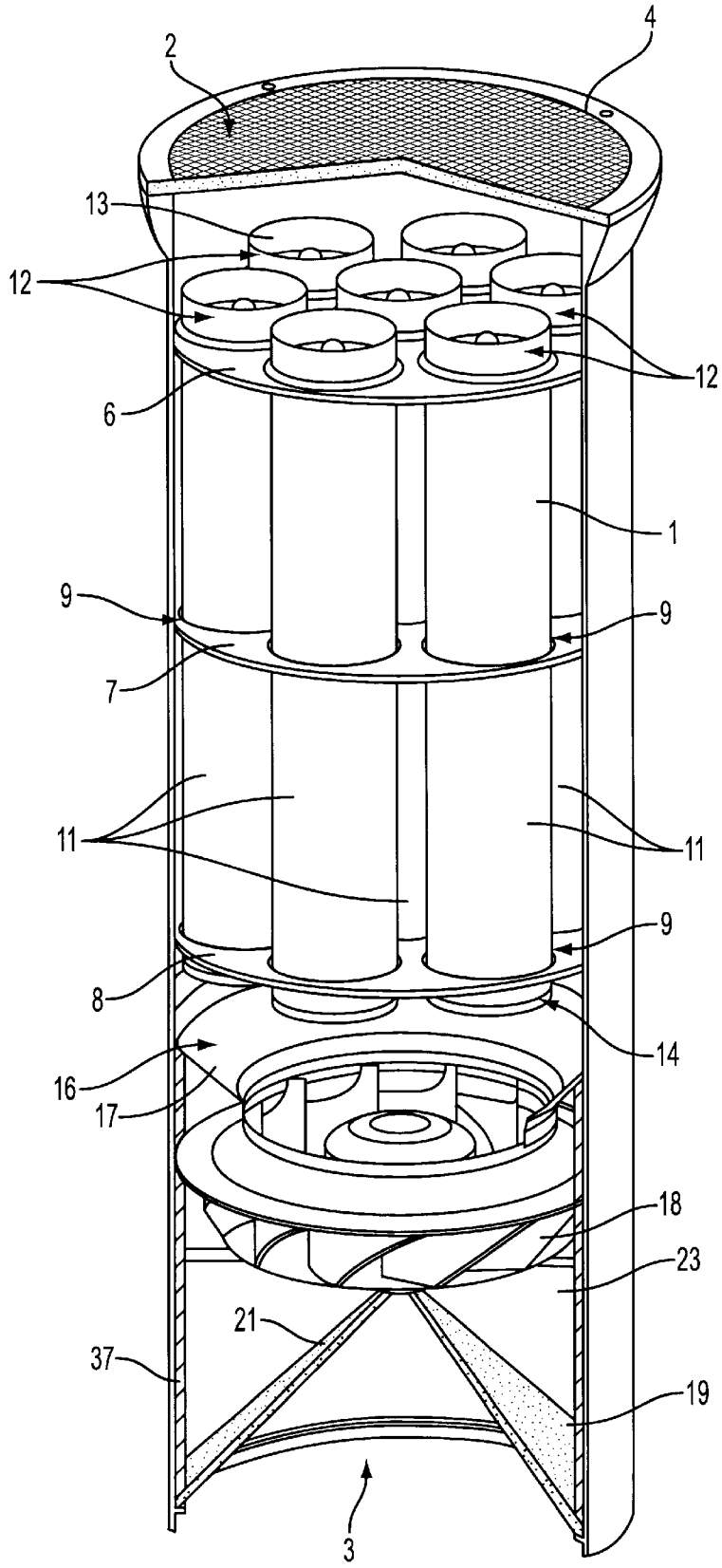

The invention relates to a device for cleaning gases, in particular air, with an electrostatic filter unit inside a tube-shaped covering, which has an intake opening at one end and an outlet opening at the other end for a gas flow or airflow to be cleaned. The device is installed inside a housing with an air intake opening and an air outlet opening and an essentially airtight, closed surface shell.

As a result of the increasing forward push in environmental consciousness in recent years, progressively higher requirements must be met with respect to clean air as well maintaining the clean air. Meeting the increasingly stricter legal limits for contaminating the air we breathe with all types of pollutants has become a major challenge. In view of this, considerable efforts are made, in particular in the industrial sector, to meet the legal limits for air pollution values.

Different types of air cleaning devices are known, in which different operational principles are realized. Particularly good results are obtained with an air cleaner having an electrostatic filter unit, as described for example in the German reference DE 195 30 785 C1. The filter unit for this air cleaner comprises a gas ionizer and, following in flow direction, a tube-shaped electrostatic precipitator. The gas ionizer consists of an outer tube made of metal and a cylindrical insulating body on the inside, which supports a metallic ribbon spiral with the tips arranged tightly side-by-side. The precipitator consists of outer and inner tubes that are arranged concentric to each other. A high-voltage field is generated and maintained between the outer tube for the ionizer and the metallic ribbon spiral, as well as between the outer tube and the inner tube of the precipitator, which initially ionizes the particles in the air and then precipitates these on the tubes of the precipitator. A filter unit of this type is described in German reference DE 39 30 872 C2, to which we also point for additional details. The air cleaners containing these electrostatic filter units, which are known from German reference DE 195 30 785 C1, permit only a limited flow-through of air. They are designed as stand-alone devices and above all can be used for cleaning the room air in living rooms, restaurants, offices and smaller business spaces. Since their capacity for technical reasons cannot be increased easily, they are hardly suitable for use in the industry. Thus, the filtering and air cleaning devices used in the ventilation and air exhaust systems in the industry for factory buildings and production areas are based on the principle of mechanical filtering, and/or electrostatic precipitators with horizontal plate arrangements. These air cleaners require a high expenditure to achieve a sufficiently high cleaning effect.

Reference EP 0 352 451 A2 discloses an electro-filter for solid materials in gases, for which a gas to be cleaned is guided through pipes in which foreign-body particles are electrostatically precipitated out. The pipes are welded together solidly and form a rigid, self-contained spatial unit.

U. S. Reference U.S. Pat. No. 4,042,354 A describes an electrostatic gas-cleaning device, for which electrode-forming pipes are installed inside a housing in support plates, thereby also forming a rigid, self-contained spatial unit.

Thus, it is the object of the invention is to provide an additional air cleaner of the aforementioned type, which is particularly suited for use in the industry and which makes it possible to meet with minimum expenditure the strict limit values specified for the pollution levels in the air.

This object is solved according to the invention in that several or all filter units, extending parallel to each other, which are combined to form an assembly that is adapted to the inside space of the housing and can be installed into or removed from the housing as a unit. Further developments, useful modifications and advantageous embodiments of the device according to the invention are described herein.

In many application cases, particularly if the device is designed to be free standing, the filter units can be inserted from one end of the housing into the holders provided inside the housing. In particular with larger air-cleaning systems according to the invention or with devices installed into the air ducts for air conditioning or ventilation systems, it is desirable to provide access to the filter units on the side of the housing in order to allow access and facilitate the replacement or maintenance. For that reason, one modification of the invention provides an opening for accessing the filter units on the side of the housing, which opening can also be closed. When provided with support legs, the device according to the invention with the cylindrical housing is suitable to be set up as a freestanding unit in factory buildings, workshops and other production areas. Of course, the device can also be used while positioned horizontally or at a slant, for example in air conditioning and ventilation systems for buildings, ships or aircraft.

To simplify the design and operation of the device and at the same time ensure an optimum air-cleaning effect in all filter units, all filter units can be connected to a joint control arrangement. The measures according to another embodiment have a positive effect on the air cleaning because they result in an even load for all filter units, thus achieving on the one hand the best possible cleaning effect and, on the other hand, an extension of the service life for all filter units. By designing the air intake on the housing delimited by an edge surface curved toward the outside in an arc toward the housing outside wall, the air can be suctioned in without eddies from the space surrounding the housing, which considerably improves the effect of the device. A longer service life and longer maintenance intervals for the filter units as well as a secure cleaning effect of the device can be provided by incorporating pre-filtering of the air before it enters the filter units. As a result, larger pollutant particles are filtered out of the airflow before it reaches the filter units. A metal filter can be provided as intake filter, which is installed on the housing such that it can be removed easily and is easy to clean. The filter can be cleaned independent of the maintenance cycles of the filter units. An ozone filter can be provided for removing ozone that develops during the electrostatic air cleaning from the airflow leaving the filter units. The effectiveness of the afterfilter and its easy maintenance in particular are of particular importance for this.

In another advantageous embodiment of the device according to the invention, the cleaned airflow leaving the housing can be equalized. A retaining space can be provided between the outlet for the filter units and the afterfilter. This results in not only a pressure equalization over the complete outlet cross section, but also offer space for one or more fans for moving the air through the filter units. Sound dampening material can be provided to increase the commercial acceptance of the device by reducing its noise emission. A diffuser can be provided to evenly distribute the cleaned airflow leaving the housing.

In one advantageous arrangement, the electrostatic filter units are arranged in parallel with the corresponding pipes. In another advantageous modification, the filter units are installed in the housing and, simultaneously, ensure that the airflow entering the housing flows completely through the filter units and is cleaned. An even more reliable mounting of the filter units in the housing is achieved through the installation of additional support walls, the openings or installation openings of which are aligned axis-parallel and which hold and support the filter units at several locations.

In other arrangements, the housing can be designed as hollow-cylindrical column or as column with a polygonal cross section, for example a rectangular or square cross section.

The present invention can be used in existing air conditioning or ventilation systems.

The device according to the invention has a number of advantages. Combining individual filter units to form at least one assembly that is adapted to the inside of the housing and can be inserted into or removed from the housing facilitates the handling of a device of this type. The user friendliness achieved in this way is important, particularly since the users of such cleaning devices frequently have little or no special knowledge of the equipment.

The device according to the invention has the following advantages:

Designing the device with several parallel filter units permits the cleaning of large flows or air, so that the device is particularly suitable for use in large spaces, such as factory buildings, shops and manufacturing plants for the industry. The housing for the device can be realized in different ways, so that the device can be adapted to various spatial operating conditions. Thus, the device is also well suited to be integrated into existing or newly installed air ducts in the ventilation systems or air-conditioning systems of buildings, ships or aircraft. The filter units used effect a thorough cleaning of the air. In the process, even very small pollutant particles and suspended particles are removed from the air and deposited in the electrostatic filter units. This is achieved in particular with the tube-shaped design of the preferably used filter units. Another advantage of the invention is that the air is guided essentially in a straight line inside the housing and the filter units. Air turbulence and obstacles restricting the flow are therefore mostly eliminated. As a result of the low flow resistance inside the device, only a relatively low fan capacity is required, which reduces the energy requirement and the noise emission of the device, thus making it more acceptable to the user. Yet, the device is cost-effective, requires low maintenance and is versatile and flexible with respect to use.

In the following, the invention is explained in further detail with the aid of the drawing. The following is shown respectively in a perspective representation:

FIG. 1 A first exemplary embodiment of the device according to the invention.

Figure 2:
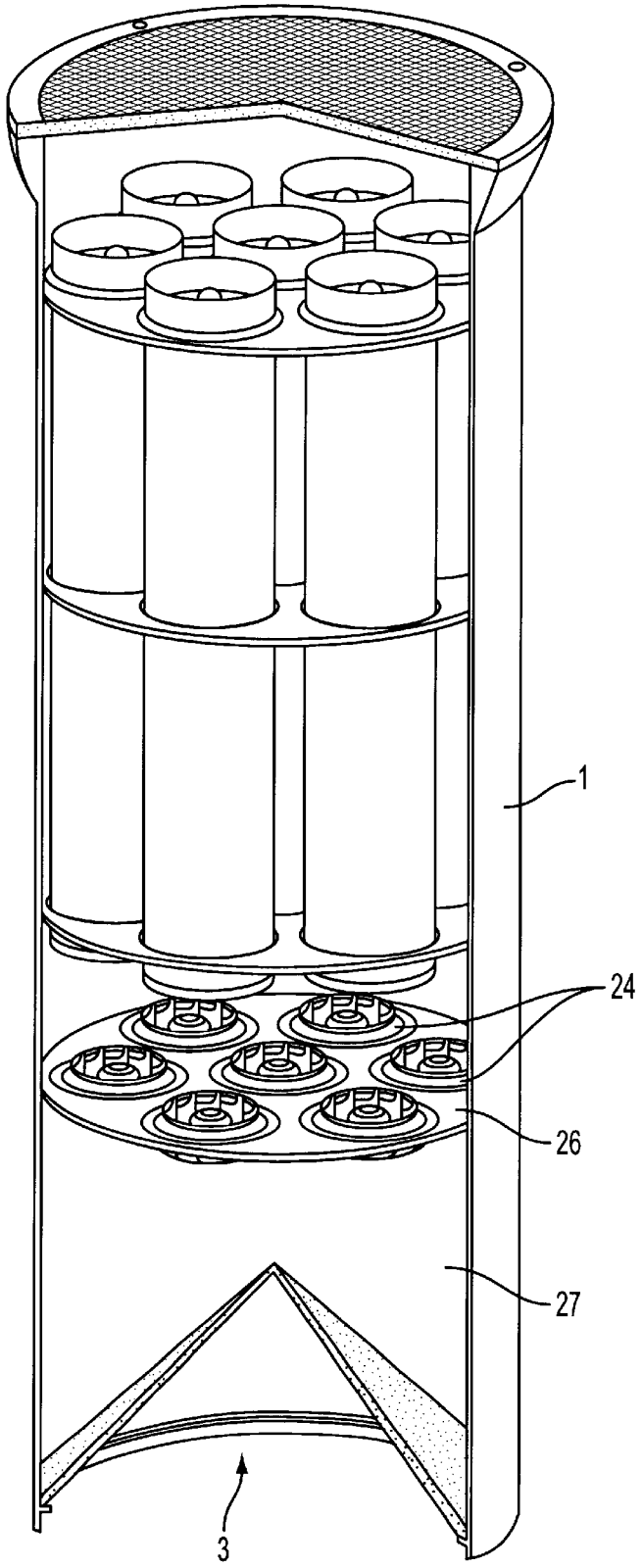

FIG. 2 A second exemplary embodiment of the device according to the invention.

Figure 3:
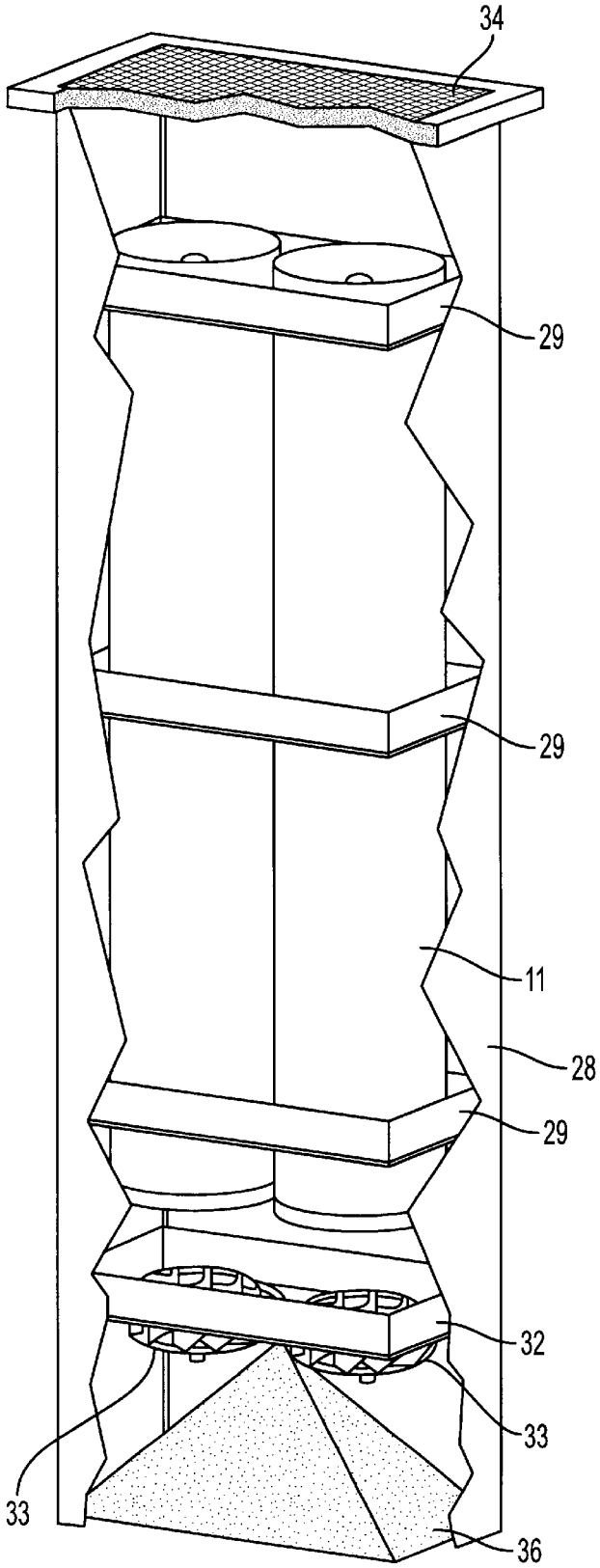

FIG. 3 A third exemplary embodiment of the device according to the invention.

FIG. 1 shows a first exemplary embodiment of the device according to the invention, in a perspective, partially cut-open view. The reference number 1 designates an essentially cylindrical housing for an air cleaner according to the invention. The housing is designed as airtight sheet metal shell and is provided in the drawing with an air intake opening 2 on the upper front and an air outlet opening 3 on the lower front. The air intake opening 2 is covered with an intake filter 4, which extends over the complete width of the air intake opening. This intake filter 4 can be a metal filter, which can be removed from the housing and can be cleaned. It functions to filter out large air pollutants before the airflow reaches the inside of the housing.

Three support walls 6, 7 and 8, which extend in radial direction to the housing axis and are provided with openings 9, are installed on the inside of the housing. The openings 9 function as installation openings and insertion openings for filter units 11 and are adapted to the outer contour of these units. They are aligned in axial direction.

The filter units are provided with an outer cylindrical covering 12. The functional parts of the filter units are not shown in further detail in the drawing. These consist of a gas ionizer, comprising an outer tube and an insulating body that is arranged concentrically inside the outer tube. A so-called serrated ribbon, meaning a helical metallic ribbon with the tips arranged tightly side-by-side, is installed inside a helical groove on the insulating body. A tube-shaped electrostatic precipitator of concentrically arranged tubes with flow channels extending in-between follows the gas ionizer. A high-voltage field is generated between the outside pipe of the gas ionizer and the metallic ribbon spiral, as well as between the concentrically arranged pipes of the precipitator. This type of design for the filter units offers only low resistance to an airflow, thus ensuring the precipitation of even very small particles from the air that flows through the filter unit. Further details of the filter units used herein are already described in the initially mentioned German reference DE 39 30 872 C2, to which we expressly refer herein.

The flow of air entering the filter units through an air intake 13 leaves the filter units through the air outlet openings 14 that are axially aligned with the air intake. An air space 16 is located in the area of the air outlet openings 14 of filter units 11, which air space functions to equalize the pressure inside the housing 1. The air space 16 empties into a funnel 17, which guides the airflow toward a fan 18. The fan 18 suctions in the air to be cleaned through the intake filter 4 and the filter units 11 and moves it through an afterfilter 19 and the air outlet opening 3 of housing 1 to the outside. The afterfilter 19 is an active charcoal mat for the embodiment shown herein. This mat is inserted in the manner of a conical shell into the air outlet opening 3 of housing 1, in such a way that the tip 21 of the conical shell points toward the inside.

The inside wall of the housing is provided with sound-damping material 37, at least in the section between the air outlet openings 14 of the filter units 11 and the air outlet opening 3. This material dampens or absorbs the noise from the flowing air and the running noises from the fan 18 or the fans 33.

The joint control for the filter units 11 and the fan 18 is installed in a switch box 22 that is attached to the outside of the housing.

The device shown herein can be set up on legs, which are not shown in the drawing, so that an airflow can be moved through the housing with the lowest possible resistance. The device is intended in particular for setting up in large spaces, e.g. factory buildings, shops, laboratories, and the like. It precipitates oil and paint mist, sweating vapors, dust and a multitude of other damaging components and pollutants out of the air. Since the device can precipitate out even extremely small particles from the air, it frees the room air reliably of all types of allergens.

In the same way as the space 16, the space 23 between the fan and the afterfilter 19 in the shape of a conical shell also functions to equalize the pressure. Thus, the airflow sucked into the housing 1 leaves the housing distributed over the complete cross section of the air outlet opening. As a result, an unpleasant air draft at the housing outlet is mostly avoided.

Since the filter units allow the airflow to pass without much resistance, only a relatively weak fan 18 is required to maintain a flow of air inside the filter units. It means that the device emits only low noises.

FIG. 2 shows another exemplary embodiment of the invention. This embodiment differs from the one shown in FIG. 1 only in that several fans 24 are provided in place of a single fan, which are arranged in an additional support wall 26. This type of embodiment has the advantage of even lower noise emissions, owing to the smaller fans. The larger air space 27, provided downstream of the fans 24, reliably equalizes the flow and pressure differences developing between the fans 24. In this way, the airflow leaving the housing 1 is again distributed over the complete width of the air outlet opening 3.

FIG. 3 shows another exemplary embodiment of the device according to the invention, for which the housing 28 has a rectangular shape. Two filter units 11 are arranged parallel to each other inside this housing. These filter units have the same design as the filter units described in connection with FIG. 1. In the case of FIG. 3, the filter units 11 are held inside rectangular support walls 29, which are adapted to the inside dimensions of housing 28 and are combined to form one structural unit. This structural unit can be inserted and removed as a complete unit through a flap 31 in the housing. As a result, these filter units can be inserted into larger housings or into the air ducts of ventilation systems or air conditioning systems in buildings, ships or aircraft and the like. An additional rectangular support wall 32 contains two fans 33, which move the air to be cleaned through the intake filter 34, the filter units 11, as well as through an afterfilter 36 on the outlet side. The afterfilter 36 in this case is designed as pyramid-type shell with a rectangular base, which consists of an active charcoal mat, as is the case in FIGS. 1 and 2.

In the case of FIGS. 1 and 2, the filter units 11 can be removed and inserted individually or as a bundle in axial direction from or into the housing once the intake filter 4 has been removed. Of course, a flap can also be provided on the side of the housing, as for the exemplary embodiments shown in FIGS. 1 and 2, through which the filter units can be replaced.

What is claimed is:

1. A device for cleaning a gas, comprising:

a housing having a gas intake opening and a gas outlet opening for gas flow; and a plurality of electrostatic filter units, each provided with a tube-shaped covering, the filter units:having an essentially airtight arrangement with the housing and being combined to form a filter assembly inside the housing such that the assembly can be inserted and removed from the housing in one piece.

2. A device according to claim 1, wherein the housing has an opening, which can be at least partially closed, for the insertion and removal of the filter assembly.

3. A device according to claim 1, wherein the housing is provided with support legs for a vertical installation and orientation.

4. A device according to claim 1, further comprising a joint control arrangement connected to all of the filter units.

5. A device according to claim 1, further comprising means for evenly guiding and distributing the gas flow to all of the filter units, the guiding and distributing means being provided at the gas intake opening of the housing.

6. A device according to claim 1, wherein the gas intake opening of the housing is delimited by a curved edge surface.

7. A device according to claim 6, wherein the housing has an outside wall, the edge surface being curved from the gas intake opening of the housing in an arc toward the outside wall of the housing.

8. A device according to claim 1, further comprising at least one intake filter for pre-filtering the gas to be cleaned arranged at the gas intake opening of the housing.

9. A device according to claim 8, wherein the intake filter is removably installed directly on the gas intake opening of the housing for pre-filtering the gas to be cleaned by all of the filtering units.

10. A device according to claim 1, further comprising at least one afterfilter arranged at the gas outlet opening of the housing.

11. A device according to claim 10, wherein the afterfilter is an ozone filter.

12. A device according to claim 10, wherein the afterfilter is a conical-shell shaped insert with a tip and having an active charcoal mat, the afterfilter being inserted concentrically into the gas outlet opening of the housing with the tip pointing inward into the housing.

13. A device according to claim 10, wherein the filter units and the afterfilter define an air space inside the housing.

14. A device according to claim 10, further comprising at least one fan provided between an air outlet of the filter units and the afterfilter to generate the gas flow that flows from the gas intake opening of the housing, through the filter units, and to the gas outlet opening of the housing.

15. A device according to claim 1, further comprising sound damping material provided inside of the housing at least in an area between an outlet of filter units and the gas outlet opening of the housing.

16. A device according to claim 1, further comprising a diffuser arranged at the gas outlet opening of the housing to distribute the flow of gas leaving the filter units evenly across a complete cross section of the gas outlet opening of the housing.

17. A device according to claim 1, wherein the filter units are arranged parallel to each other inside the housing.

18. A device according to claim 1, wherein the tube-shaped coverings have an outside diameter and the housing has an interior wall, the device further comprising at least one radial support wall with openings adapted to the outside diameter of the tube-shaped covering as a holder for the filter units such that the filter units can be inserted parallel to each other into the openings of the support wall and that channels extending inside the housing wall between neighboring filter units and between the filter units and the interior wall of the housing are closed off in an axial direction by the at least one radial support wall.

19. A device according to claim 1, wherein the housing is a hollow cylindrical column.

20. A device according to claim 1, wherein the housing is a column with a polygonal cross section.

21. A device according to claim 1, wherein the housing is designed to form a section of a duct system for at least one of an air conditioning and a ventilation system, the device being designed to be integrated into the duct system.

* * * * *